United States Patent [19]

Ushiro

[11] Patent Number: 4,691,742

[45] Date of Patent: Sep. 8, 1987

[54] SURPLUS WARP YARN TREATING DEVICE OF LOOM

[75] Inventor: Masayuki Ushiro, Tokyo, Japan

[73] Assignee: Nissan Motor Co., Ltd., Yokohama, Japan

[21] Appl. No.: 814,998

[22] Filed: Dec. 31, 1985

[30] Foreign Application Priority Data

Jan. 11, 1985 [JP] Japan ..... 60-1471[U]
May 17, 1985 [JP] Japan ..... 60-72150[U]

[51] Int. Cl.[4] ..... D03D 49/20

[52] U.S. Cl. ..... 139/1 R; 139/97; 139/35

[58] Field of Search ..... 139/97, 1 R, 304, 302, 139/35, 291 R

[56] References Cited

U.S. PATENT DOCUMENTS 1,027,887 5/1912 Owen ..... 139/97
2,389,809 11/1945 Moessinger ..... 139/302
3,461,920 8/1969 Sakamoto ..... 139/302
4,404,997 9/1983 Ushiro et al. ..... 139/302

*Primary Examiner*—Henry S. Jaudon
*Assistant Examiner*—T. Graveline
*Attorney, Agent, or Firm*—Schwartz, Jeffery, Schwaab, Mack, Blumenthal & Evans

[57] ABSTRACT

A device for treating a surplus warp yarn drawn from a warp beam of a loom consists of a drive member rotatable by the warp beam. A rotational force of the drive member is transmitted through a transmission device to a driven member. The driven member is secured to a take-up reel disposed separate from the warp beam. The surplus warp yarn drawn from the warp beam is wound up on the take-up reel rotatable with the driven member, thereby preventing the surplus warp yarn from getting entangled with regular warp yarns drawn from the warp beam.

19 Claims, 6 Drawing Figures

SURPLUS WARP YARN TREATING DEVICE OF LOOM

BACKGROUND OF THE INVENTION

1. Field of the Invention

The present invention relates to a device for treating surplus warp yarns and unnecessary yarns drawn from a warp beam in a loom.

2. Description of Prior Art

It has been already proposed that the loom is provided with a device for treating a surplus warp yarn and/or unnecessary yarn drawn from a warp beam, in which the yarn drawn from the warp beam is once passed on a guidė roll to be turned over and again wound on a part of the warp beam.

However, with this device, the surplus warp yarn and/or the unnecessary yarn unavoidably gets entangled with regular warp yarns drawn from the warp beam. This is predominant particularly in a loom on a recent trend of speeding up loom operation.

SUMMARY OF THE INVENTION

A surplus warp yarn treating device according to the present invention consists of a drive member disposed separate from a warp beam of a loom and rotatable by the warp beam. The drive member is drivingly connected through a transmission means to a driven member. The driven member is connected to a take-up reel which is rotatable in timed relation to the driven member. The take-up reel is so adapted that a surplus yarn drawn from the warp beam is wound up thereon thereby to be suitably treated.

Accordingly, the surplus warp yarn drawn from the warp beam is wound up on the take-up reel disposed separate from the warp beam, and therefore surplus warp yarn is prevented form getting entangled with regular warp yarns on the warp beam, so that the surplus warp yarn can be suitably treated. Additionally, the surplus warp yarn to be wound on the take-up reel will be prevented from cutting if the transmission means is of the type wherein an excessive tension is not applied to the surplus warp yarn to be wound on the take-up reel.

BRIEF DESCRIPTION OF THE DRAWINGS

The features and advantages of the device according to the present invention will be more clearly appreciated from the following description taken in conjunction with the accompanying drawings in which same reference numerals designate corresponding parts and elements, and in which.

DETAILED DESCRIPTION OF THE INVENTION

Figure 1:
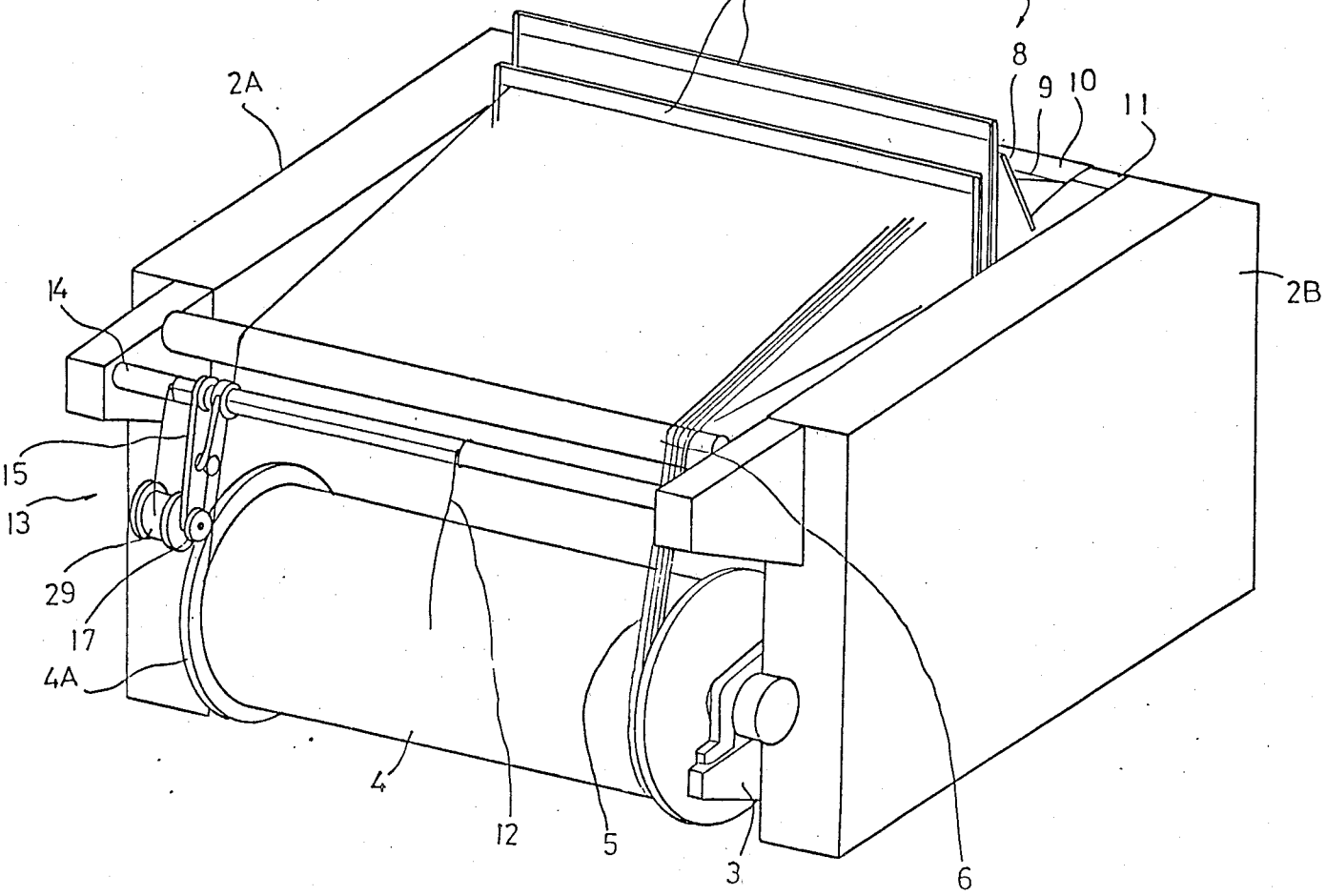
FIG. 1 is a perspective view of a loom equipped with an embodiment of a surplus warp yarn treating device according to the present invention.

Referring now to FIG. 1 of the drawings, there is shown a loom 1 equipped with a device 13 for treating a surplus warp yarn 12 drawn from a warp beam 4 of the loom 1, which device is of an embodiment according to the present invention. The loom 1 includes right and left side frames 2A, 2B which are provided with warp beam support racks 3, respectively. The warp beam 4 is rotatably supported at its opposite end sections on the support racks 3. Warp yarns 5 are rolled on the warp beam 4 and drawn therefrom to be supplied to weave a fabric 10. The warp yarns 5 drawn out from the warp beam 4 are passed on a back roller 6 and passed through a headle 7, and thereafter extend through a reed 8 to the cloth fell 9 of the woven fabric 10. The woven fabric 10 is passed on a breast beam 11 and supplied to a take-up motion (not shown).

Figure 2:
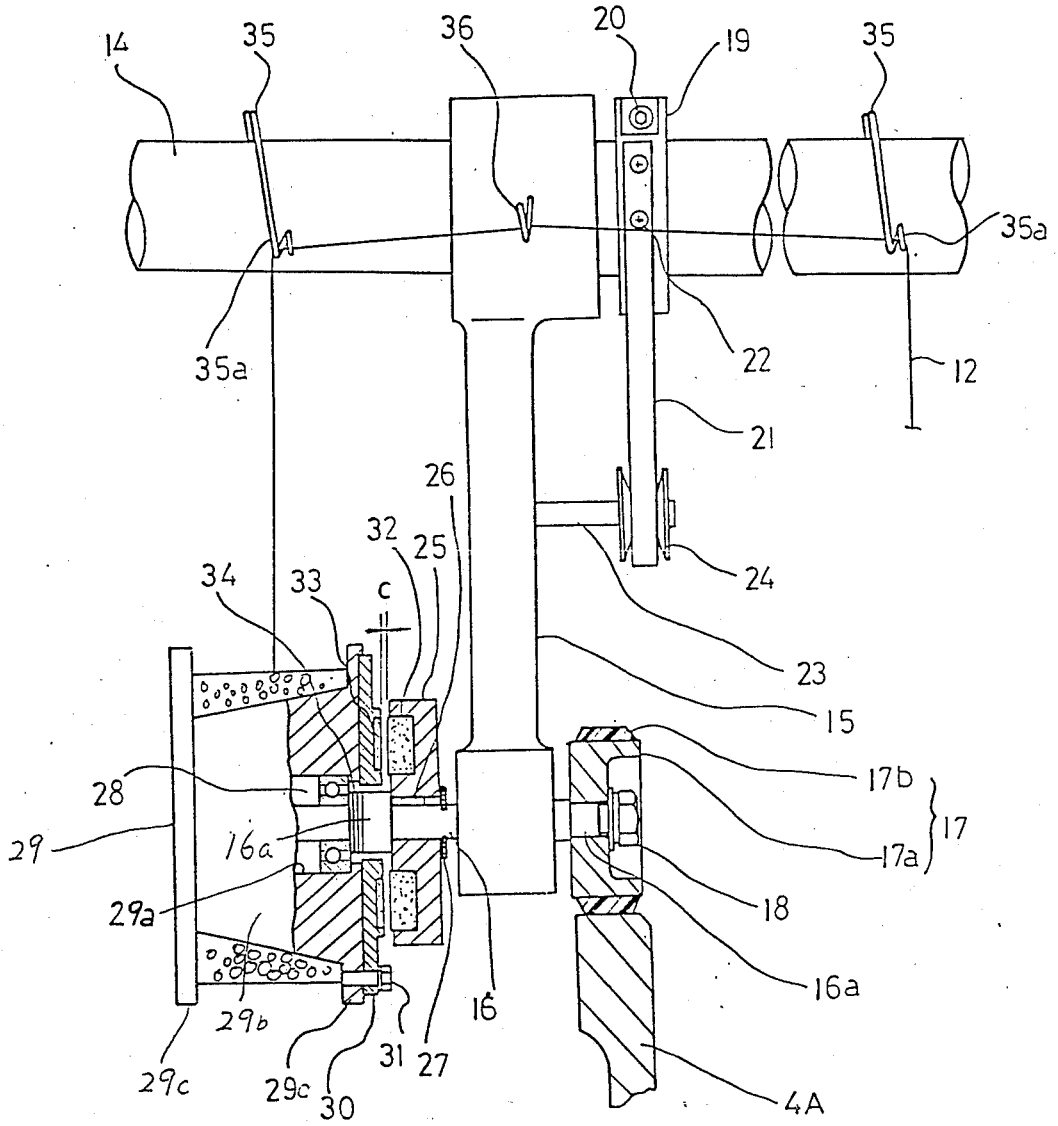
FIG. 2 is a front elevation, partly in section, of the surplus warp yarn treating device of FIG. 1.

The surplus warp yarn treating device 13 will be discussed in detail hereinafter with reference to FIGS. 2 to 4. It is to be noted that the term "surplus warp yarn" covers also an unnecessary or free yarn rolled in the warp beam 4. The surplus warp yarn treating device 13 includes a support rod 14 rigidly connected between the side frames 2A, 2B of the loom 1. The support rod 14 is located above and parallel with the warp beam 4. A support arm 15 has an upper end section which is rotatably mounted on the support rod 14. The lower end section of the suppport arm 15 rotatably supports a shaft 16. A roller 17 fixedly fits on an end section **16*a* of the shaft 16 and prevented from getting off therefrom by means of a nut 18. The roller 17 includes an annular core member 17*a* whose cylindrical outer periphery is covered with a hard rubber 17*b***.

An adjustment member 19 having a slit **19*a* is disposed to embrace the support rod 14 and secured in position upon a bolt 20 being fastened. A plate spring 21 has an end section secured to the adjustment member 19 by means of a small screw 22. The other end section of the plate spring 21 is in contact with a roller 24 which is rotatably mounted on a shaft 23 projected from the support arm 15 at the intermediate section side surface. Accordingly, the support arm 15 is biased counterclockwise in FIG. 3, so that the roller 17 is brought into press contact with the peripheral surface of an annular flange section 4A of the warp beam 4, thereby causing the roller 17 and accordingly the shaft 16** to rotate.

An annular drive member 25 is mounted on the shaft 16 on the side of the other end section relative to the support arm 15 and secured in position by means of a key 26 and a snap ring 27. Additionally, a take-up reel 29 is rotatably mounted through a bearing 28 on the other end section of the shaft 16. The take-up reel 29 is formed with a central hole **29*a* in which the shaft 16 is located, wherein the bearing 28 is interposed between the shaft 16 and the inner wall of the take-up reel 29. The take-up reel 29 consists of a frusto-conical winding section 29*b* on which the surplus warp yarn 12 is wound. The winding section 29*b* are integrally formed at the opposite ends with flanges 29*c* between which the surplus warp yarn 12** is wound.

An annular driven member 30 is secured to the take-up reel 29 on the end face on the side of the drive member 25 by means of bolts 31. The driven member 30 and the take-up reel 29 may be integral with each other. Annular permanent magnets 32, 33 are fixedly secured to the drive and driven members 25, 30, respectively, at the faces opposite to each other in such a manner that each magnet is embedded in the drive or driven member. The permanent magnets 32, 33 are located spaced from each other to form a clearance C therebetween, and arranged in such a manner that the different poles of the magnets 32, 33 are opposite to each other through the clearance C. Accordingly, the permanent magnet 33 can rotate upon rotation of the permanent magnet 32, so that the drive member 25 with the permanent magnet 32 and the driven member 30 with the permanent magnet 33 constitute a transmission device of the type wherein the drive and driven members 25, 30 are rotatable independently from each other even during transmission of a rotational force from the drive member to the driven member. It is to be noted that the axial location of the take-up reel 29 is adjustable by changing the number of shims 34 disposed between the bearing 28 and a larger-diameter section 16*a* of the shaft 16, thereby adjusting the clearance C between the permanent magnets 32, 33 so that the torque transmitted from the drive member 25 to the driven member 30 is adjustable in accordance with the thickness of the warp yarn 12.

First and second yarn guides 35, 35 are provided to guide the surplus warp yarn 12 from the warp beam to the take-up reel 29. Each yarn guide 35 formed of a wire material is generally C-shaped and has two guide mails 35*a*, 35*b* which are formed by being annularly curled. Each yarn guide 35 is fitted on the support rod 14 as clearly shown in FIG. 4. The first yarn guide 35 is located above a yarn drawing-out position of the warm beam 4 at which position the surplus warp yarn 12 is drawn out from the warp beam 4. The second yarn guide 35 is located above the take-up reel 29. Additionally, a yarn guide 36 having only one guide mail is installed to the upper end section of the support arm 15. It will be understood that the surplus warp yarn 12 is guided through the guide mail 35*a* of the first yarn guide, the yarn guide 36, and the guide mail 35*a* of the second yarn guide in this order, and introduced onto the take-up reel 29.

The manner of operation of the surplus warp yarn treating device 13 will be discussed hereinafter.

Figure 3:
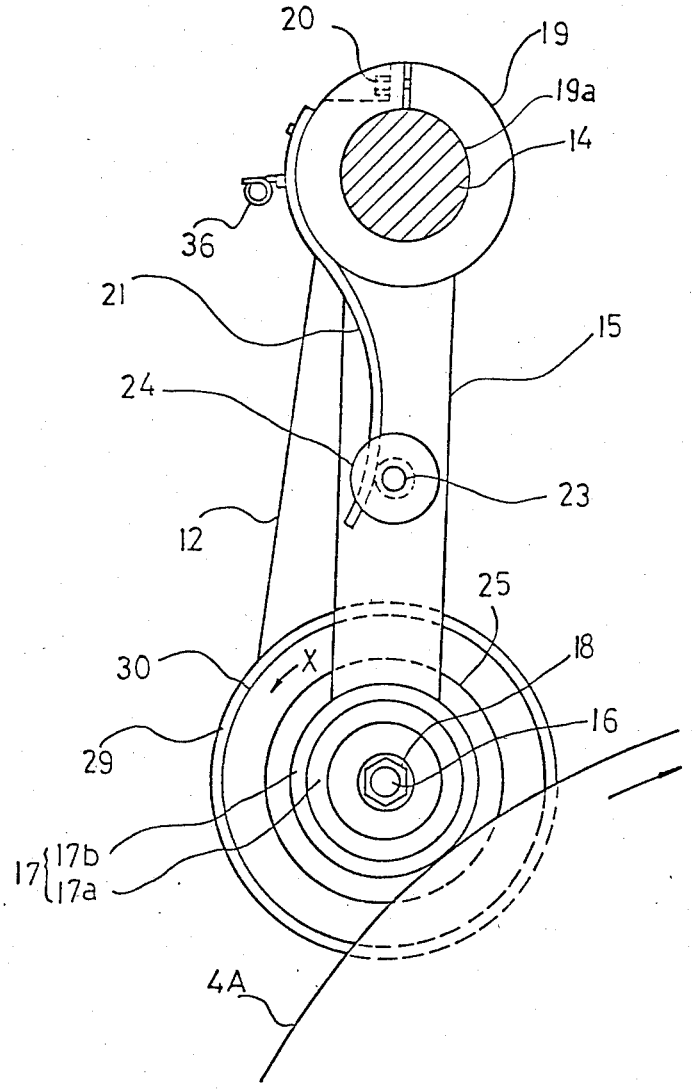
FIG. 3 is a side elevation of the device of FIG. 2.
Figure 4:
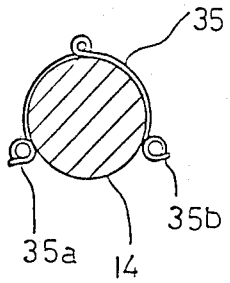
FIG. 4 is a side view of a part of the device of FIG. 2.

During operation of the loom, the warp beam 4 and accordingly the flange section 4A thereof rotate at a low speed, thereby rotating the roller 17 in press contact with the flange 4A in the direction of an arrow X in FIG. 3. The rotation of the roller 17 is transmitted to the drive member 25 through the shaft 16 and the key 26, thus rotating the permanent magnet 32. With the rotation of permanent magnet 32, the permanent magnet 33 rotates under the attraction between the permanent magnets 32, 33, so that the driven member 30 rotates in the direction of the arrow X. Accordingly, the take-up reel 29 also rotates in the direction of the arrow X with the rotation of the driven member 30, thereby winding up surplus yarn 12 guided through the gudie mail 35*a* of the first yarn guide, the yarn guide 36 and the guide mail 35*a* of the second yarn guide.

With the thus arranged surplus warp yarn treating device 13, since the surplus warp yarn 12 is drawn and wound up on the take-up reel 29 separate from the warp beam 4, the surplus warp yarn 12 is prevented from getting entangled with regular warp yarns 5 drawn from the warp beam 4. Further, the take-up reel 29 is driven by the warp beam 4 through the transmission device operated under the attraction of the magnets 32, 33, and therefore yarn cutting or slackening hardly arise even if the yarn winding diameters of the warp beam 4 and/or of the take-up reel 29 changes, by virtue of suitably setting the attraction force between the magnets 32, 33. Consequently, the surplus warp yarn 12 can be drawn to the take-up reel 29 under an appoximately predetermined tension. Furthermore, since the take-up reel 29 is disposed in the vicinity of the warp beam 4, an operation is sufficient to be made in the vicinity of the warp beam 4 even if the yarn cutting arises, thus facilitating the operation of the treating the surplus warp yarn. Additionally, the take-up reel 29 is arranged to be driven by the warp beam 4 rotating at a low speed, and therefore driving the take-up reel 29 is easily accomplished without using a special decelerator for rotational speed, thus simplifying the construction of the surplus warp yarn treating device 13.

While the transmission device has been shown and described as using the magnets 32, 33, it will be understood that, for example, linear materials having an elasticity may be used in palce of the magnets so that the linear materials are planted like a brush on the opposite faces of the drive and driven members 25, 30 in such a manner that the tip end sections of linear materials planted on the drive and driven members 25, 30 are in contact with each other.

Figure 5:
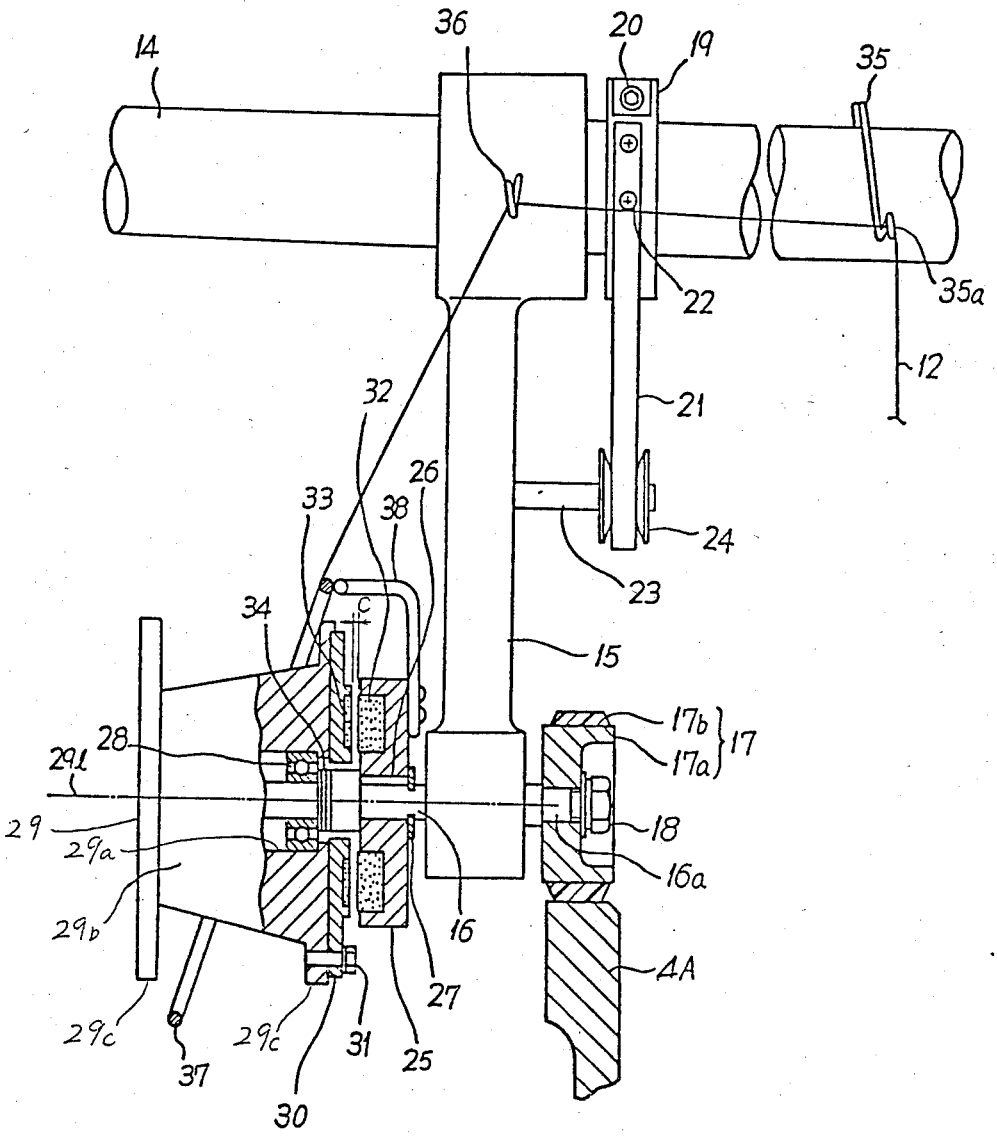
FIG. 5 is a front elevation similar to FIG. 2 but showing another embodiment of the surplus warp yarn treating device according to the present invention.
Figure 6:
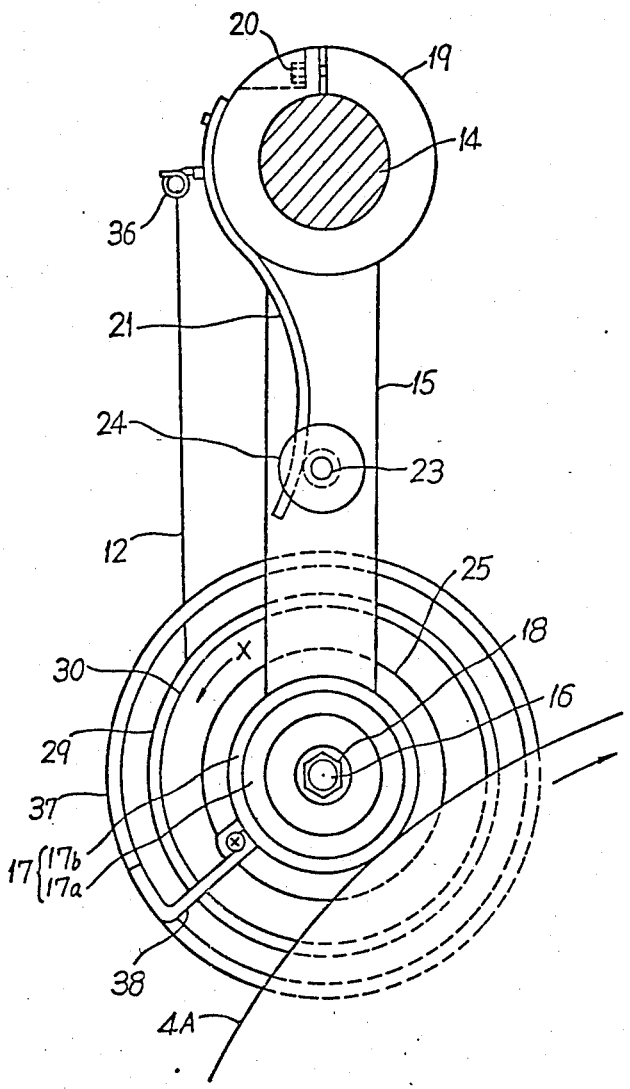
FIG. 6 is a side elevation of the device of FIG. 5.

FIGS. 5 and 6 illlustrate another embodiment of the surplus warp yarn treating device 13 which is similar to the embodiment of FIGS. 1 to 4 with the exception that a travese guide 37 is provided to distribute the surplus warp yarn 12 whole over the winding section 29*b* of the take-up reel 29.

The traverse guide 37 is ring-like and has a circular cross-section. The traverse guide 37 is disposed around the outer peripheral surface of the winding section 29*b* to be spaced from the winding section outer peripheral surface. The traverse guide 37 is so located that an imaginary axis perpendicular to an imaginary plane parallel with the traverse guide 37 inclines relative to the axis 29λ of the take-up reel 29, i.e., the extension of the axis of the shaft 16. The traverse guide 37 is fixed at a section thereof to a L-shaped stay 38 secured to the back face of the drive member 25. As shown in FIG. 5, the surplus warp yarn 12 drawn from the warp beam 4 is introduced onto the take-up reel 37 through the guide mail 35*a* of the yarn guide 35, the yarn guide 36, and the outer peripheral surface of the travese guide 37 in this order.

In operation of the surplus warp yarn treating device 13 of FIGS. 5 and 6, when the drive member 25 rotates, the traverse guide 37 rotates together with the drive member 25 as a single unit, in which the surplus warp yarn 12 introduced through the yarn guides 35, 36 is passed on the peripheral surface of the traverse guide and wound up on the winding section 29*b* of the take-up reel 29.

With the thus arranged surplus warp yarn treating device 13, since the rotational speed of the take-up reel 29 is nearly determined by the speed with which the surplus warp yarn 12 is fed out from the warp beam 4, the difference in speed is produced between the traverse guide 37 and the take-up reel 29. As a result, a position of the traverse guide 37 at which position the graverse guide is brought into contact with the surplus warp yarn 12 changes along the ring-like outer periphery of the traverse guide 37 moment by moment with the rotation of the drive member 25. In other words, since the traverse guide 37 is installed to be inclined relative to the axis 29λ of the take-up reel 29, the location of the surplus warp yarn 12 relative to the take-up reel 29 in the axial direction changes moment by moment, thus providing the traverse movement to the surplus warp yarn 12 to be introduced onto the peripheral surface of the winding section 29*b* of the take-up reel 29. Accordingly, the surplus warp yarn 12 is wound generally uniformly whole over the peripheral surface of the take-up reel winding section 29*b*. It will be understood that the traverse guide 37 may be securely connected to the shaft 16.

What is claimed is:

1. A device for treating a surplus yarn drawn from a warp beam in a loom, said device comprising:

a first roller fixedly mounted on a rotatable shaft and in contact with and driven by a part of the warp beam;

a drive member in drivable connection with the rotatable shaft and spaced from said first roller;

a driven member drivable by said drive member;

transmission means for drivingly connecting said drive member with said driven member so that said drive and driven members are rotatable relative to each other even during transmission of a rotational force from said drive member to said driven member; and a take-up reel disposed separate from the warp beam and rotatable in timed relation to the warp beam by said driven member, the surplus warp yarn drawn from the warp beam being wound up on said take-up reel.

2. A device as claimed in claim 1, wherein said drive member is fixedly mounted on said rotatable shaft.

3. A device as claimed in claim 2, wherein said first roller is in press contact with an annular flange section of the warp beam.

4. A device as claimed in claim 2, wherein said take-up reel is rotatably mounted through a bearing on said rotatable shaft, in which said driven member is coaxially fixedly connected to said take-up reel.

5. A device as claimed in claim 4, further comprising traverse means for providing traverse movement to the surplus warp yarn to be fed onto said take-up reel, said traverse means including a ring-like member disposed spacedly around said take-up reel and fixedly connected to said drive member so as to be rotatable with said drive member, said ring-like member being so located that an axis perpendicular to a plane parallel with said ring-like member inclines relative to the axis of said rotatable shaft.

6. A device as claimed in claim 4, wherein said transmission means includes a first permanent magnet fixedly connected to said drive member, and a second permanent magnet fixedly connected to said driven member, said first and second permanent magnets being different in pole from each other and facing each other maintaining a clearance therebetween.

7. A device as claimed in claim 6, further comprising means for adjusting said clearance.

8. A device as claimed in claim 7, wherein said adjusting means includes at least one shim for adjusting the distance between said take-up reel and said drive member.

9. A device as claimed in claim 6, further comrising a support arm having a first end section rotatably mounted on said rotatable shaft, and a second end section rotatably mounted on a support rod fixedly connected between oppositely disposed frames of the loom.

10. A device as claimed in claim 9, further comprising means for biasing said support arm in such a direction as to bias said roller onto an annular flange section of the warp beam.

11. A device as claimed in claim 10, wherein said biasing means includes a second roller rotatably connected to said support arm, and a plate spring having a first end section fixedly connected to said support rod, and a second end section in contact with said second roller.

12. A device as claimed in claim 11, wherein said support rod extends parallel with the warp beam.

13. A device as claimed in claim 12, wherein said rotatable shaft extends parallel with said support rod.

14. A device as claimed in claim 13, further comprising a first yarn guide connected to said suppport rod and located above the warp beam to guide the surplus warp yarn drawn from the warp beam, and a second yarn guide connected to said support rod and located above said take-up reel to guide the surplus warp yarn toward said take-up reel.

15. A device as claimed in claim 1, wherein said drive member is disposed independent from the warp beam.

16. A device as claimed in claim 1, wherein said driven member and said take-up reel are integral with each other.

17. A device as claimed in claim 1, further comprising traverse means for providing traverse movement to the surplus warp yarn to be fed onto said take-up reel.

18. A device for treating a surplus yarn drawn from a warp beam in a loom, said device comprising:

a first roller fixedly mounted on a rotatable shaft and in contact with and driven by a part of the warp beam;

a drive member fixedly mounted on said rotatable shaft and spaced from said first roller;

a driven member drivable by said drive member;

transmission means for drivingly connecting said drive member with said driven member so that said drive and driven members are rotatable relative to each other even during transmission of a rotational force from said drive member to said driven member; and a take-up reel disposed separate from the warp beam and rotatable in timed relation to said driven member, the surplus warp yarn drawn from the warp beam being wound up on said take-up reel.

19. A device for treating a surplus yarn drawn from a warp beam in a loom, said device comprising:

a first roller fixedly mounted on a rotatable shaft and in press contact with and driven by an annular flange of the warp beam;

a drive member fixedly mounted on the rotatable shaft and spaced from said first roller;

a driven member drivable by said drive member;

transmission means for drivingly connecting said driven member with said driven member so that said drive and driven members are rotatable relative to each other even during transmission of a rotational force from said drive member to said driven member; and a take-up reel disposed separate from the warp beam and rotatable in timed relation to said driven member, the surplus warp yarn drawn from the warp beam being wound up on said take-up reel.

* * * * *